US010054888B2

(12) United States Patent
Kobayashi et al.

(10) Patent No.: US 10,054,888 B2
(45) Date of Patent: Aug. 21, 2018

(54) DEVICE FOR DETECTING TRAVEL DISTANCE, IMAGE FORMING APPARATUS, AND METHOD FOR DETECTING TRAVEL DISTANCE

(71) Applicant: KONICA MINOLTA, INC., Chiyoda-ku, Tokyo (JP)

(72) Inventors: Yuji Kobayashi, Toyohashi (JP); Takaki Kato, Toyoake (JP); Masayuki Fukunaga, Toyohashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 36 days.

(21) Appl. No.: 15/414,792

(22) Filed: Jan. 25, 2017

(65) Prior Publication Data

US 2017/0235267 A1 Aug. 17, 2017

(30) Foreign Application Priority Data

Feb. 12, 2016 (JP) ..... 2016-024631

(51) Int. Cl.
*G03G 15/00* (2006.01)

(52) U.S. Cl.
CPC ..... *G03G 15/5062* (2013.01); *G03G 15/657* (2013.01); *G03G 2215/00616* (2013.01); *G03G 2215/00645* (2013.01); *G03G 2215/0135* (2013.01)

(58) Field of Classification Search
CPC ..... G03G 15/5062; G03G 15/657; G03G 2215/00616; G03G 2215/00645; G03G 2215/0135
See application file for complete search history.

(56) References Cited

U.S. PATENT DOCUMENTS

2002/0085079 A1 7/2002 Maruyama
2009/0167885 A1* 7/2009 Okutomi ..... G02B 7/365 348/222.1

(Continued)

FOREIGN PATENT DOCUMENTS

JP 2002-202705 A 7/2002
JP 2013-257187 A 12/2013
JP 2014-119432 A 6/2014

*Primary Examiner* — David Banh

(74) *Attorney, Agent, or Firm* — Buchanan Ingersoll & Rooney PC

(57) ABSTRACT

A device for detecting a travel distance of a sheet is provided. The device includes a light source for irradiating the sheet surface; an imaging sensor for capturing an image of a pattern of the sheet surface by light reflected from the sheet; a discrete Fourier transformation portion for performing discrete Fourier transformation on two patterns obtained by image capturing at a time interval by the imaging sensor; a high wave number component removal portion for using a threshold determined based on a cycle of concave-convex of the sheet surface to remove a high wave number component from the two patterns having been subjected to the discrete Fourier transformation; and a travel distance calculation portion for determining a travel distance of the sheet based on a phase relationship between the two patterns from which the high wave number component removal portion has removed the high wave number component.

13 Claims, 15 Drawing Sheets

(56) References Cited

U.S. PATENT DOCUMENTS

| | | | | |
|---|---|---|---|---|
| 2012/0251141 | A1* | 10/2012 | Henderson | G03G 15/5029 399/49 |
| 2013/0135635 | A1* | 5/2013 | Nakamura | H04N 1/603 358/1.9 |
| 2013/0148987 | A1* | 6/2013 | Arakawa | G03G 15/5062 399/15 |
| 2015/0130829 | A1* | 5/2015 | Aizaki | H04N 1/50 345/591 |

* cited by examiner

FIG. 8

T1 PAPER INFORMATION

| TYPE K8 OF PAPER SHEET | CYCLE h OF CONCAVE-CONVEX | WAVE NUMBER H8/ FRAME | THRESHOLD Hth |
|---|---|---|---|
| NON-COATED PAPER (PULP PAPER) | 40 μm | 50 | 60 |
| COATED PAPER | 10 μm | 200 | 210 |
| RESIN PAPER | 1.5 μm | 1333 | 1350 |

DEVICE FOR DETECTING TRAVEL DISTANCE, IMAGE FORMING APPARATUS, AND METHOD FOR DETECTING TRAVEL DISTANCE

The present U.S. patent application claims a priority under the Paris Convention of Japanese patent application No. 2016-024631 filed on Feb. 12, 2016, the entirety of which is incorporated herein by reference.

BACKGROUND OF THE INVENTION

1. Field of the Invention

The present invention relates to a device for detecting a travel distance, an image forming apparatus, and a method for detecting a travel distance.

2. Description of the Related Art

Image forming apparatuses, e.g., printers, copiers, and Multi-functional Peripherals (MFPs): multifunction devices or combination devices, form an image onto a surface of a paper sheet while the image forming apparatuses convey the paper sheet. For example, an electrophotographic image forming apparatus forms a toner image on a surface of an image carrier to transfer the toner image onto a paper sheet while the electrophotographic image forming apparatus moves the image carrier and the paper sheet at the same linear velocity as each other. In order to control a conveyance speed of the paper sheet or of the image carrier, an image forming apparatus of this type is provided with a device for detecting a travel distance per a predetermined amount of time corresponding to the conveyance speed.

As a method for detecting a travel distance, a method is known in which a moving object is irradiated with light to make areas of light and darkness depending on irregularities of the surface of the moving object, an image of the moving object irradiated with light is captured at predetermined time intervals, and an amount of difference in position of a common pattern of the two images is detected. The method enables detection of a travel distance even if the moving object has a solid color surface, in other words, even if the surface color of the moving object is monochrome.

Conventional technologies for detecting a travel distance based on two images obtained by image capturing are described, for example, in Japanese Unexamined Patent Application Publication Nos. 2002-202705, 2013-257187, and 2014-119432.

The first publication discloses performing filtering for reducing gray levels of an image prior to matching to compare between two images, and filtering for preventing a value from suddenly changing relative to a conveyance speed detected.

The second publication discloses calculating a cross-correlation function between two image patterns (speckle patterns). For the calculation, discrete Fourier transformation is performed on the image patterns and processing of removing background is executed in a frequency space.

The third publication discloses an inspection device for determining appropriateness of conveyance speed of a sheet. The inspection device calculates a conveyance speed of the sheet on the basis of an image correlation of two speckle images picked up with a given time interval; and performs filter processing for removing a variation component of a given band width on the conveyance speed calculated.

The second publication describe the technology of detecting a travel distance by calculating a cross-correlation through discrete Fourier transformation of an image. The technology, however, involves a problem that an error occurs in the result of detection. Such an error occurs when the technology described in the second publication is used to perform the background removal processing.

The first publication describes the technology of detecting a travel distance by matching between two images (comparing between two images in a real space). The technology, however, sometimes fails to detect a travel distance when the images have too many characteristic points. In other words, the technology has a difficulty in detecting, at a high accuracy, a travel distance of a moving object of which a surface has subtle irregularities.

The third publication describes the technology of performing the filter processing after calculation of a conveyance speed at predetermined time intervals and accumulation of the conveyance speed. In order to determine appropriateness of a conveyance speed, it takes a long time to accumulate the conveyance speed as compared with the time interval for calculation of each conveyance speed. This makes it difficult to reflect the result of determination in speed control at real time.

SUMMARY

The present invention has been achieved in light of such problems, and therefore, an object of an embodiment of the present invention is to reduce an error occurring when a travel distance is detected by discrete Fourier transformation.

To achieve at least one of the objects mentioned above, a device for detecting a travel distance of a sheet according to an aspect of the present invention includes a light source configured to irradiate a surface of the sheet; an imaging sensor configured to capture an image of a pattern of the surface of the sheet by light reflected from the sheet; a discrete Fourier transformation portion configured to perform discrete Fourier transformation on two patterns obtained by image capturing at a time interval by the imaging sensor; a high wave number component removal portion configured to use a threshold determined based on a cycle of concave-convex of the surface of the sheet to remove a high wave number component from the two patterns having been subjected to the discrete Fourier transformation; and a travel distance calculation portion configured to determine a travel distance of the sheet based on a phase relationship between the two patterns from which the high wave number component removal portion has removed the high wave number component.

Preferably, the high wave number component removal portion determines the threshold based on the cycle of concave-convex of the surface of the sheet and a size of an image plane of the imaging sensor. For example, preferably, the high wave number component removal portion determines the threshold to be a value obtained by adding a margin to a wave number calculated based on the cycle of concave-convex of the surface of the sheet and the size of the image plane of the imaging sensor.

BRIEF DESCRIPTION OF THE DRAWINGS

The above and other objects, advantages, and features of the present invention will become more fully understood from the detailed description given hereinbelow and the appended drawings which are given by way of illustration only, and thus are not intended as a definition of the limits of the present invention, and wherein:

FIG. 8 is a diagram showing an example of paper information;

DESCRIPTION OF THE PREFERRED EMBODIMENTS

Hereinafter, an embodiment of the present will be described with reference to the drawings. However, the scope of the invention is not limited to the illustrated examples.

Figure 1:
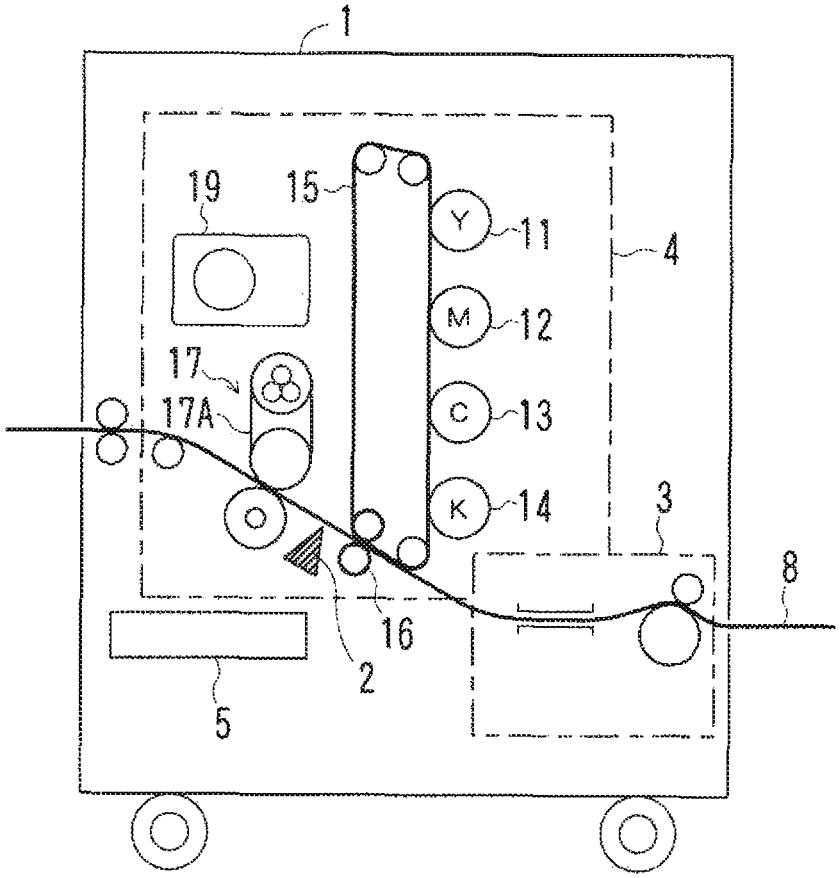
FIG. 1 is a schematic diagram showing an example of the structure of an image forming apparatus including a travel distance sensor according to an embodiment of the present invention.

FIG. 1 is a schematic diagram showing an example of the structure of an image forming apparatus 1 including a travel distance sensor 2 according to an embodiment of the present invention.

The image forming apparatus 1 is configured to operate as a printer forming an image on a long paper sheet 8. Examples of the image forming apparatus 1 include a copier, an MFP, and a facsimile machine.

The image forming apparatus 1 is provided with the travel distance sensor 2 for detecting a travel distance dL of the paper sheet 8, a paper feed portion 3 from which the paper sheet 8 is supplied, an image forming section (printer engine) 4 for forming an image electrophotographically, an engine control board 5 for controlling the image forming section 4, and so on. The paper sheet 3 is an example of a sheet. The travel distance sensor 2 is an example of a device for detecting a travel distance. The image forming section 4 is an example of an image forming portion.

The image forming section 4 includes four photoconductor units 11, 12, 13, and 14, a transfer belt 15, secondary transfer rollers 16, a belt-type fixing unit 17, and a fixing motor 19. In the image forming section 4, the photoconductor units 11, 12, 13, and 14 form four colors of toner images. The toner images are primarily transferred to the transfer belt 15 so as to be overlaid with one another. The secondary transfer rollers 16 secondarily transfer the overlaid images to a paper sheet 8. Then, the fixing unit 17 is used to apply heat and pressure to the paper sheet 8, so that the toner image is fixed onto the paper sheet 8.

For such image formation (printing), the image forming section 4 applies a travel distance dL detected by the travel distance sensor 2 to control the paper sheet 8 conveyed from the paper feed portion 3. For example, in order to avoid distortion of the toner image, the image forming section 4 controls a rotational speed of the fixing motor 19 for rotating a fixing belt 17A in accordance with a signal from the engine control board 5 in a manner to maintain a state where a conveyance speed of the paper sheet 8 passing through the secondary transfer rollers 16 is equal to a circumferential velocity of the fixing belt 17A.

In this example, the travel distance sensor 2 is disposed at a position between the secondary transfer rollers 16 and the fixing unit 17 on the paper feed path of the paper sheet 8. The travel distance sensor 2 detects a travel distance dL of the paper sheet 8 passing the position thereof. The travel distance sensor 2 may be disposed at a suitable position other than the above-described position. The configuration and functions of the travel distance sensor 2 are described later.

The paper feed portion 3 pulls a paper sheet 8 from an external roll, introduces a part of the paper sheet 8 thereinto, and sends out the paper sheet 8 to the image forming section 4. The structure of the paper feed portion 3 is not limited thereto. The paper feed portion 3 may be structured to hold a roll of the paper sheet 8 therein. Alternatively, the paper feed portion 3 may be structured to have a paper cassette within which a stack of paper sheets is loaded.

Figure 2:
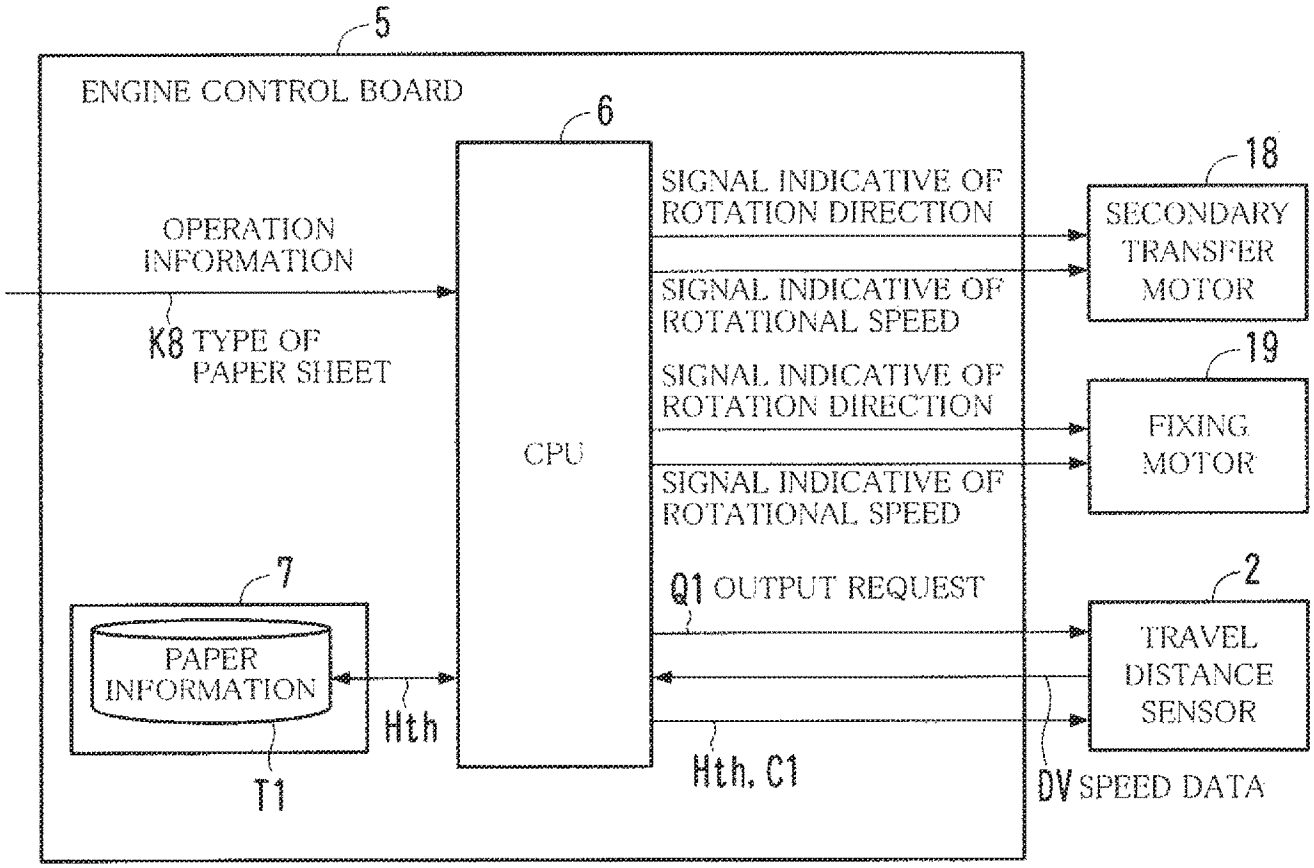
FIG. 2 is a diagram showing an example of the structure of the main part of an engine control board.

FIG. 2 is a diagram showing an example of the structure of the main part of the engine control board 5. The engine control board 5 includes a Central Processing Unit (CPU) 6 and a non-volatile memory 7.

The CPU 6 outputs a signal indicative of a rotation direction and a signal indicative of a rotational speed to each of the fixing motor 19 and the secondary transfer motor 18 for driving the rotation of the secondary transfer rollers 16. While the paper sheet 8 is conveyed, the CPU 6 sends an output request Q to the travel distance sensor 2 and obtains speed data DV therefrom. The CPU 6 fine-tunes, depending on the speed data DV obtained, the rotational speed of the fixing motor 19 or of the secondary transfer motor 18. The speed data DV is data indicating a travel distance dL detected, or, alternatively, data indicating a conveyance speed V calculated based on the travel distance dL.

The non-volatile memory 7 is used as a storage portion for storing paper information T1 in advance. The paper information T1 is detailed later.

Figure 3A:
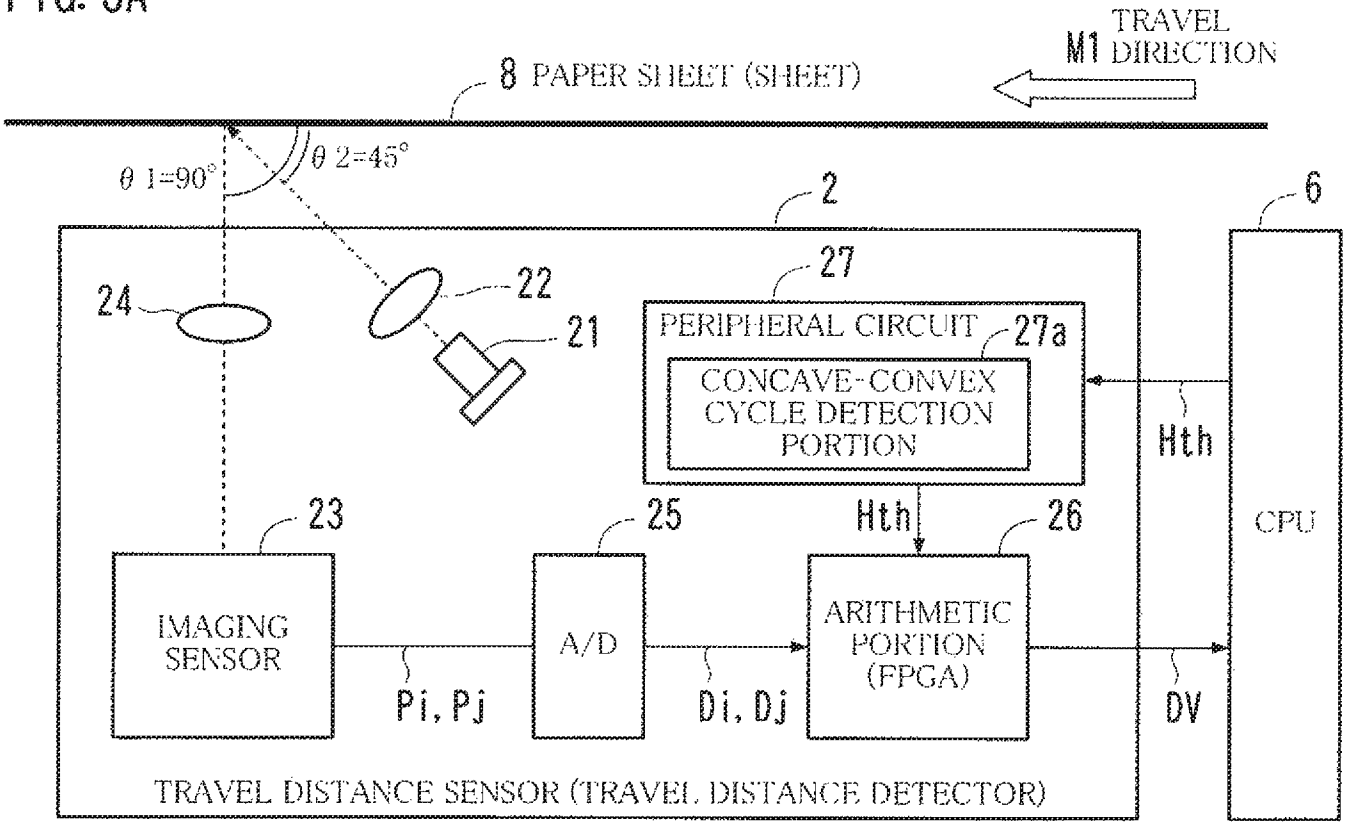
FIGS. 3A and 3B are diagrams showing an example of the structure of a travel distance sensor.
Figure 3B:
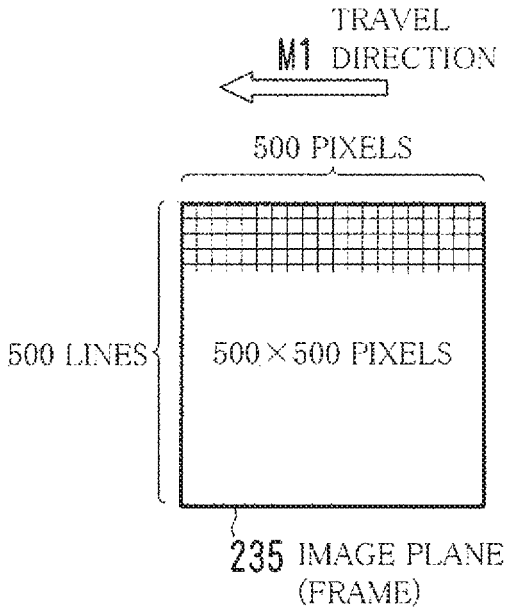
Figure 4:
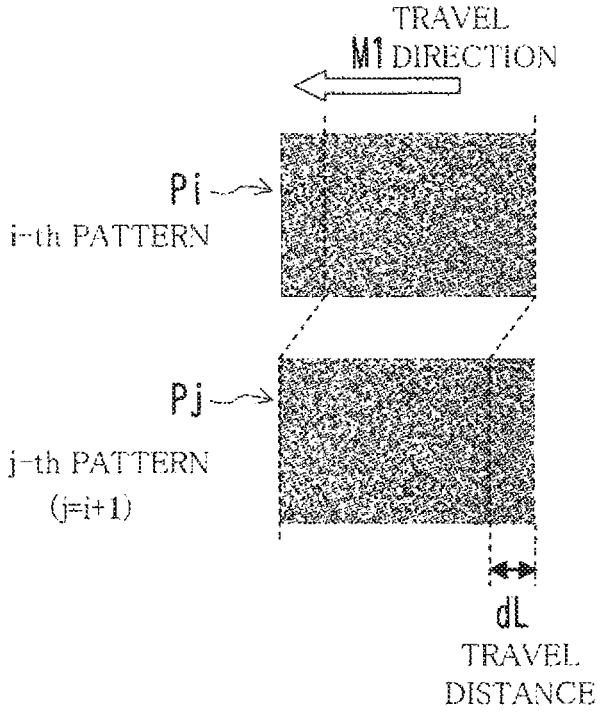
FIG. 4 is a diagram showing an example of patterns of which images are captured by a travel distance sensor.

FIGS. 3A and 3B show an example of the structure of the travel distance sensor 2. FIG. 4 shows an example of patterns Pi and Pj of which images are captured by the travel distance sensor 2.

Referring to FIG. 3A, the travel distance sensor 2 includes a light source 21, a lens 22, an imaging sensor 23, a lens 24, an AD converter 25, an arithmetic portion 26, and a peripheral circuit 27. The components are formed together as a sensor module.

The light source 21 emits laser light so that a surface of the paper sheet 8 is irradiated with the laser light. The light source 21 is, for example, a laser diode. The lens 22 collects the laser light to limit the irradiated area to a predetermined spot diameter. The angle between the laser irradiation direction and the surface of the paper sheet 8 is 45 degrees for example.

The imaging sensor 23 uses reflected light from the paper sheet 8 to capture an image of a pattern of the surface of the paper sheet 8. In this embodiment, the imaging sensor 23 is a two-dimensional photoelectric conversion device including an image plane (frame) 235 as shown in FIG. 3B. The imaging sensor 23 segments a pattern into, for example, 500×500 pixels to read the resultant. The image plane 235 has a size (frame size) of, for example, 2 mm×2 mm.

The imaging sensor 23 repeats image capturing at predetermined time intervals. The imaging sensor 23 is so controlled to output, for each image capturing, a photoelectric conversion signal corresponding to one frame. As the imaging sensor 23, a one-dimensional photoelectric conversion device may be used.

The lens 24 forms, on the image plane 235 of the imaging sensor 23, an image of a pattern of a region in the surface of the paper sheet 8. The region has a size almost the same as the frame size. The direction of the optical axis of the lens 24 is vertical to the image plane 235 of the imaging sensor 23.

The AD converter 25 converts an analogue photoelectric conversion signal outputted by the imaging sensor 23 into digital data. Thereby, image data Di and Dj are obtained which indicate pixel values of the patterns Pi and Pj respectively captured by the imaging sensor 23.

The arithmetic portion 26 calculates a travel distance dL of the paper sheet 8 based on the image data Di and Dj sent by the AD converter 25. The arithmetic portion 26 then outputs the speed data DV indicating the result of calculation. The arithmetic portion 26 is implemented by, for example, a field-programmable gate array (FPGA).

The peripheral circuit 27 includes a circuit for driving the light source 21 and the imaging sensor 23 by performing communication with the CPU 6, a circuit for operating the arithmetic portion 26, an external memory used by the arithmetic portion 26 according to the need, and a concave-convex cycle detection portion 27*a*.

The concave-convex cycle detection portion 27*a* controls, in an automatic detection mode of detecting a cycle h of concave-convex of the paper sheet 8, the arithmetic portion 26, and works as an concave-convex cycle detection portion for determining a cycle of concave-convex by performing discrete Fourier transformation on a pattern obtained after an image of the pattern of the surface of the paper sheet 8 is captured.

The travel distance sensor 2 configured as described above is assembled with the image forming apparatus 1 in such a manner that the image plane 235 of the imaging sensor 23 is parallel to the surface of the paper sheet 8, and that each line of the image plane 235 is parallel to a travel direction M1 of the paper sheet 8. The travel distance sensor 2 is used with being assembled with the image forming apparatus 1.

With the travel distance sensor 2, an image of a pattern depending on concave-convex of the surface of the paper sheet 8 is captured at a time interval of, for example, 1 ms, and, every time an image is captured, a travel distance dL during the time interval of 1 ms is detected. Referring to FIG. 4, the pattern Pi is the i-th pattern, of which an image is captured for the i-th time (herein, "i" is an integer equal to or greater than 1) among patters in time series captured periodically. Further, the pattern Pj is the j-th pattern of which an image is captured for the j-th time following the i-th time. Each of the patterns Pi and Pj is a speckle pattern which is generated by diffuse reflections and interferences of coherent laser light due to concave-convex of the surface.

The time interval for image capturing is so set that the pattern Pi and the pattern Pj partly overlap with each other.

The description goes on to a series of processing for calculating a travel distance dL based on the image data Di and Dj.

Figure 5:
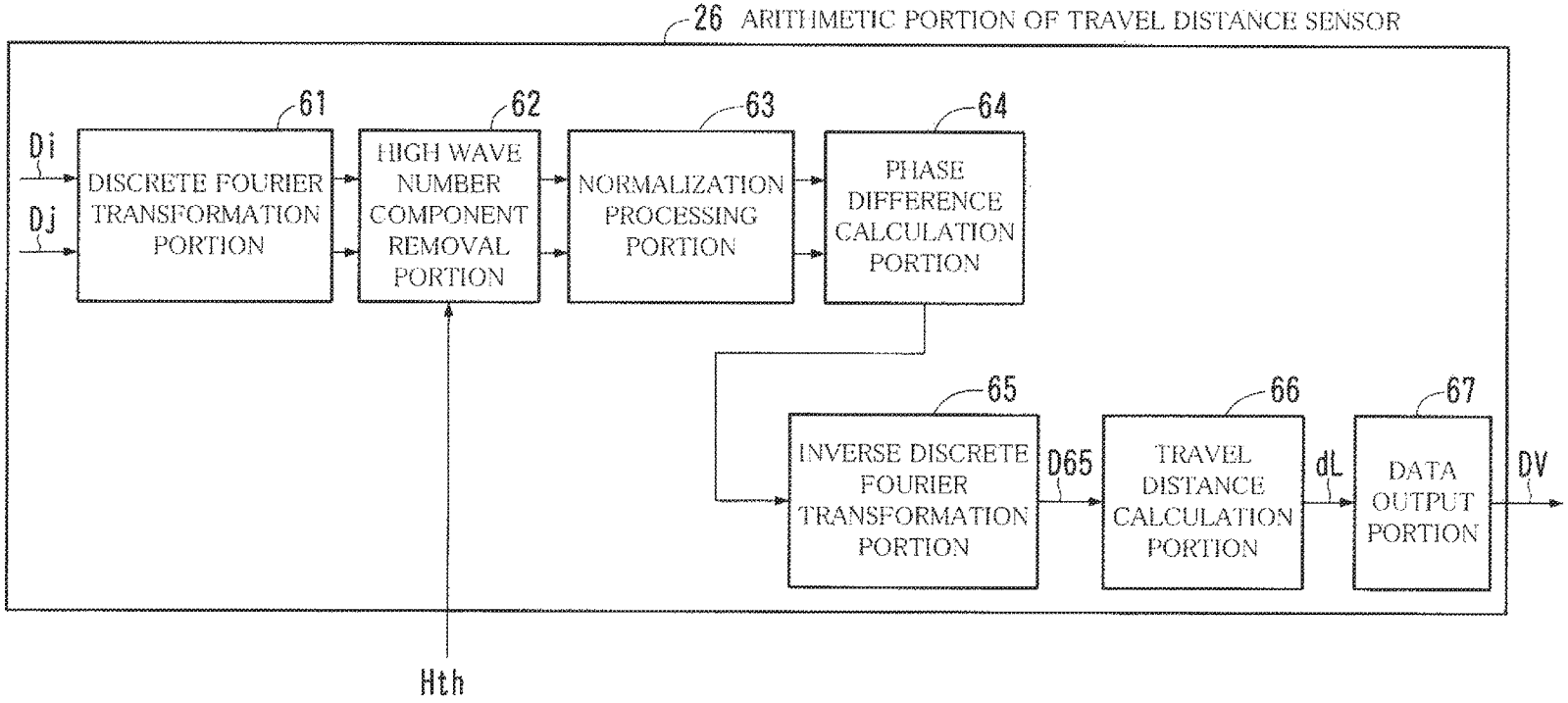
FIG. 5 is a diagram showing an example of the functional configuration of an arithmetic portion of a travel distance sensor.
Figure 6A:
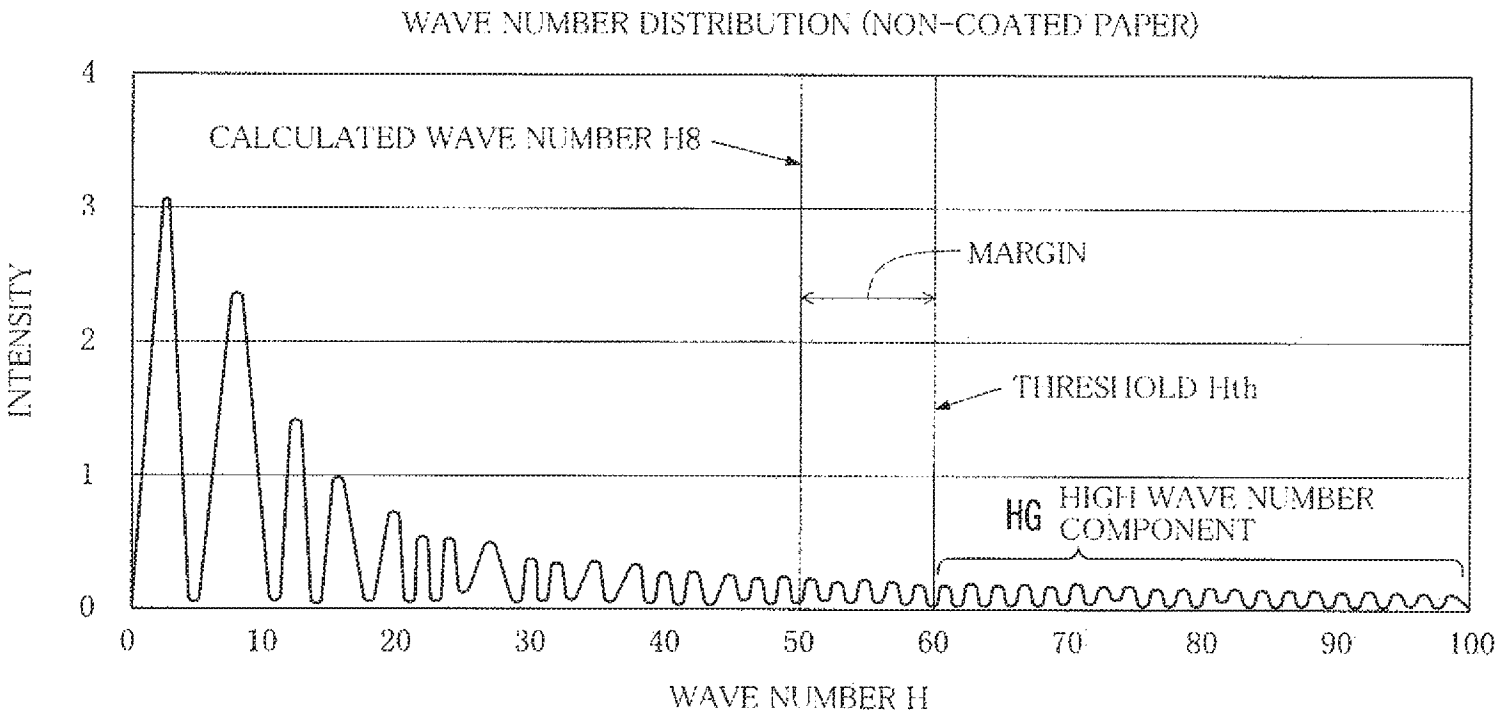
FIGS. 6A-6C are diagrams showing, in waveform, data before/after removal of high wave number component in an arithmetic portion of a travel distance sensor, and normalized data.
Figure 6B:
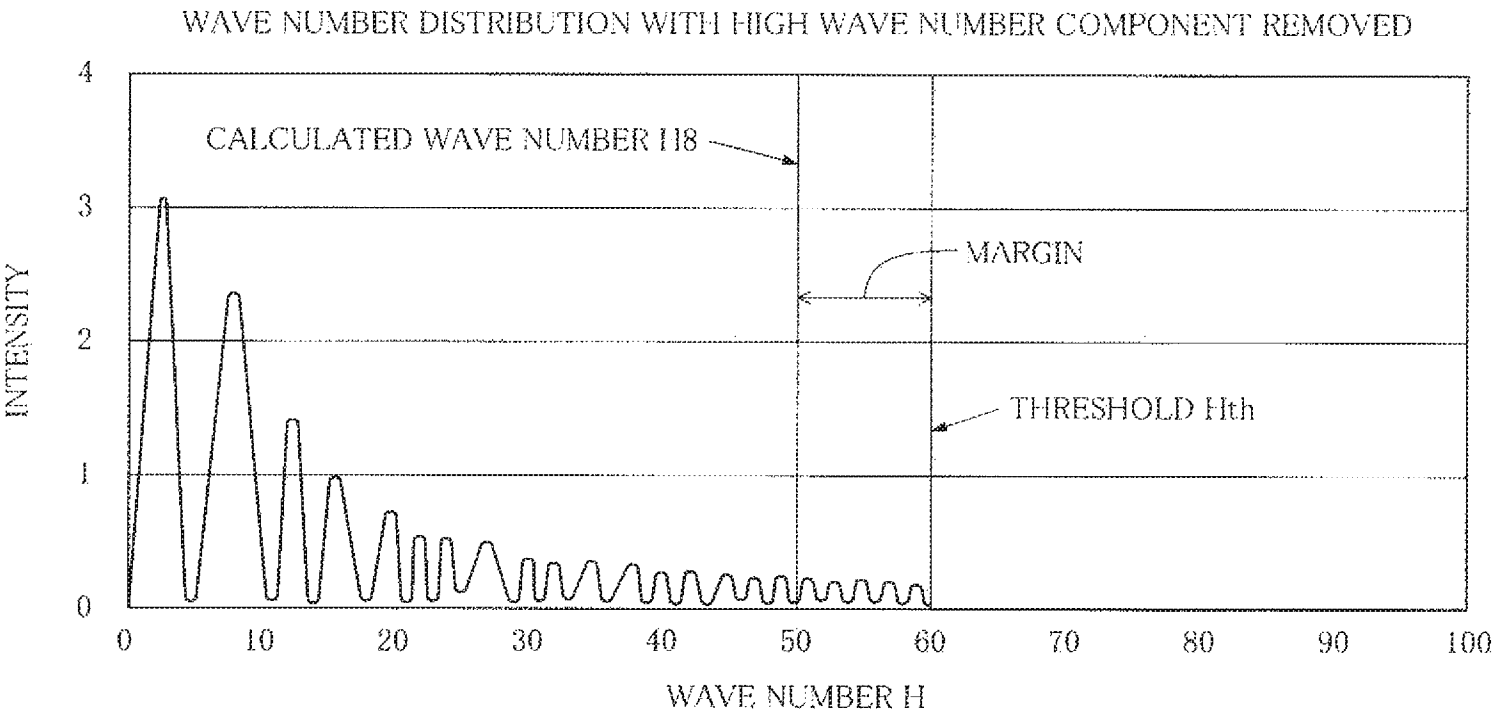
Figure 6C:
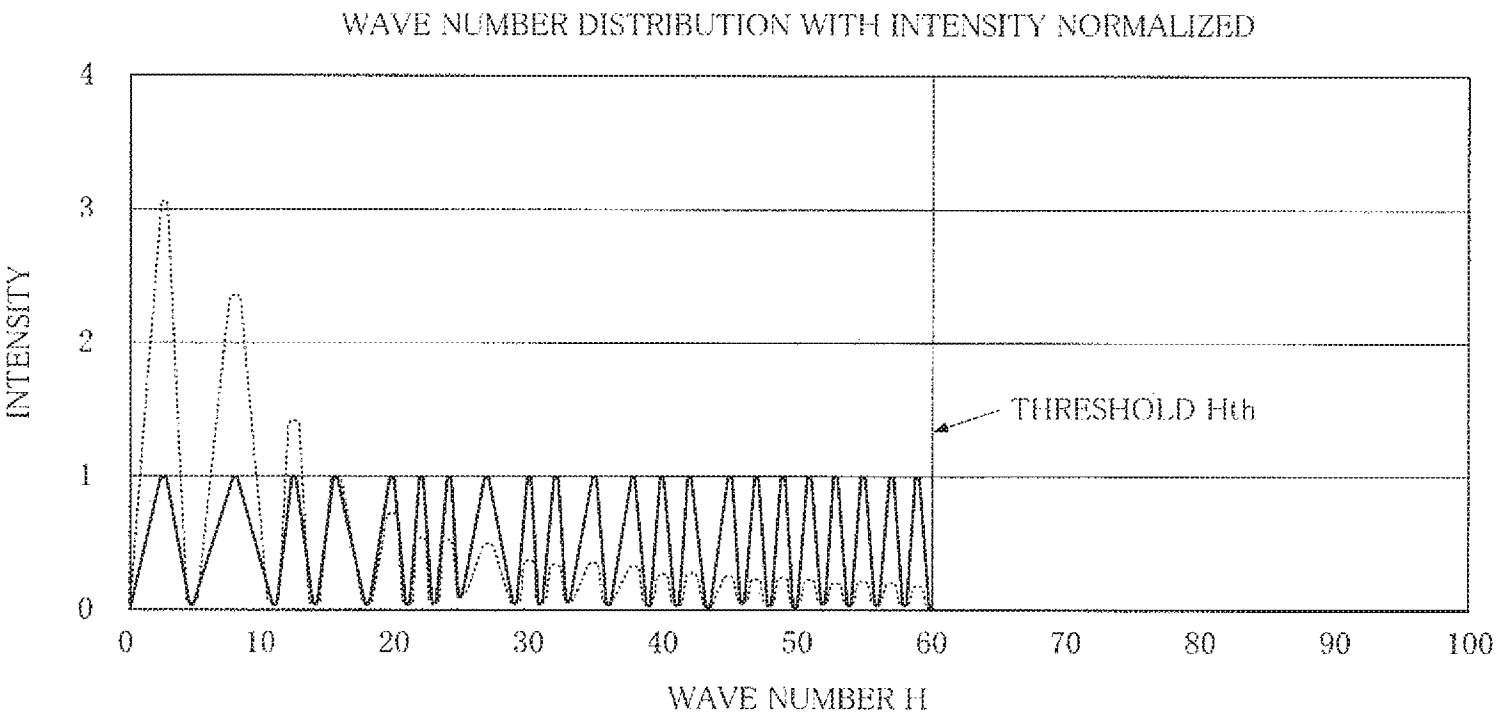
Figure 7A:
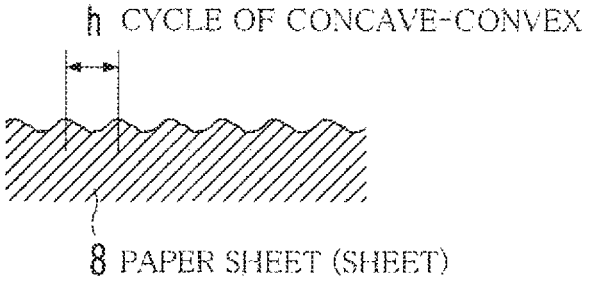
FIGS. 7A and 7B are schematic diagrams showing a cycle of concave-convex of the surface of paper and a relationship between an image plane and a wave number, respectively.
Figure 7B:
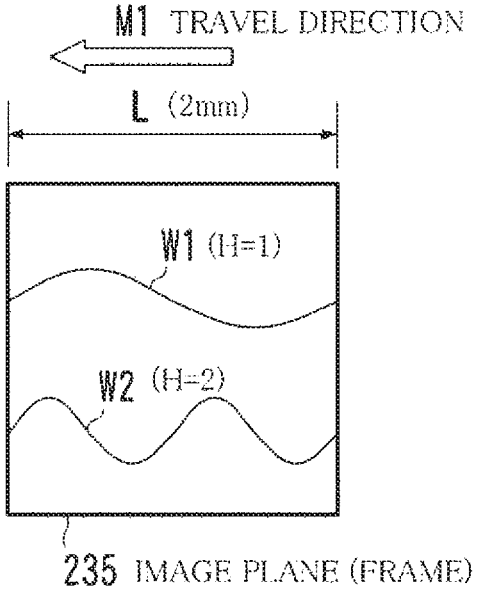

FIG. 5 shows an example of the functional configuration of the arithmetic portion 26 of the travel distance sensor 2. FIGS. 6A-6C are diagrams showing, in waveform, data before/after removal of high wave number component in the arithmetic portion 26 and normalized data. FIGS. 7A and 7B schematically show a cycle h of concave-convex of a surface of the paper sheet 8 and a relationship between the image plane 235 and a wave number H, respectively.

Referring to FIG. 5, the arithmetic portion 26 includes a discrete Fourier transformation portion 61, a high wave number component removal portion 62, a normalization processing portion 63, a phase difference calculation portion 64, an inverse discrete Fourier transformation portion 65, a travel distance calculation portion 66, and a data output portion 67. The functions of these portions are implemented by the hardware configuration of the FPGA. Instead of this, however, the functions of these portions may be implemented by a hardware configuration including a processor which executes a program for calculation.

The discrete Fourier transformation portion 61 performs discrete Fourier transformation on the image data Di and Dj on the two patterns Pi and Pj of which images are captured by the imaging sensor 23 at a time interval. The discrete Fourier transformation portion 61 receives inputs of the image data Di and Dj in order, performs the discrete Fourier transformation on the image data Di and Dj in the input order, and outputs the resultant image data Di and Dj. Alternately, the image data Di is delayed so that both the image data Di and the image data Dj are simultaneously inputted to the discrete Fourier transformation portion 61. In such a case, the discrete Fourier transformation portion 61 performs the discrete Fourier transformation on the image data Di and the image data Dj in parallel with each other.

The discrete Fourier transformation is performed on a line-by-line basis. To be specific, every time receiving an input of 500 pixel values which correspond to one line of the image data Di, the discrete Fourier transformation portion 61 performs the discrete Fourier transformation for the 500 pixel values. Since the number of lines of the image plane 235 is 500, the discrete Fourier transformation is performed five hundred times on one piece of image data Di. The five hundred results of conversion are outputted to the next stage, i.e., to the high wave number component removal portion 62, serially or at one time. The same is applied to the image data Dj.

FIG. 6A is a waveform diagram schematically showing an example of data obtained through discrete Fourier transformation on one line for the case where the paper sheet 8 is non-coated paper. As shown in the diagram, the discrete Fourier transformation is performed, so that data (wave number distribution) indicating a wave number H within a change in light and darkness (gradation) for one line and data indicating intensity of each of wave number components, namely, power spectrum information for each wave number H, is obtained.

The wave number H depends on a size (frame size) of the image plane 235, specifically, on a length L of the image plane 235 in the line direction. Stated differently, the discrete Fourier transformation is performed by using, as the wave number H, the product of reciprocal of a wave cycle and the length L (the quotient obtained by dividing the length L by cycle). Referring to FIG. 7B, since a cycle of a wave W1 is equal to the length L, the wave number H of the wave W1 is "1". Since the cycle of a wave W2 is a half of the length L, the wave number H of the wave W2 is "2".

Note that the change in light and darkness for one line of the actual patterns Pi and Pj is complicated, and contains many wave number component as shown in FIG. 6A.

The high wave number component removal portion 62 uses a threshold Hth determined based on a cycle h of concave-convex of the surface of the paper sheet 8 to remove a high wave number component HG from the image data Di and Dj on the two patterns Pi and Pj having been subjected to the discrete Fourier transformation. As discussed above the discrete Fourier transformation is performed on a line-by-line basis. Thus, the processing by the high wave number component removal portion 62 is also performed on a line-by-line basis.

As shown in FIG. 7A, the cycle h of concave-convex means a pitch of the concave-convex, namely, a distance between two adjacent concavities or two adjacent convexities, for example, on a surface part of the cross-section of the paper sheet 8. In general, as the paper sheet 8 has a smoother surface, the cycle h of concave-convex is smaller.

The threshold Hth is, for example, a wave number which is greater, by a predetermined margin, than a wave number H8 calculated based on the cycle h of concave-convex of the paper sheet 8. The wave number H8 corresponds to the number of concave-convex present within a range of the length L of the image plane 235 on the surface of the paper sheet 8. The wave number H8 is determined by dividing the length L by the cycle h of concave-convex. The threshold Hth may be a value obtained by adding a predetermined margin to the wave number H8. Alternatively, the threshold Hth may be a value obtained by multiplying the wave number H8 by a predetermined coefficient equal to or larger than 1.

FIG. 6B shows data (waveform distribution) for one line from which the high wave number component HG is removed by the high wave number component removal portion 62. As is clear by the comparison with FIG. 6A, the high wave number component removal portion 62 removes, from the data obtained through the discrete Fourier transformation, a wave number component beyond the threshold Hth as the high wave number component HG. Stated differently, the high wave number component removal portion 62 performs filter processing using a low-pass filter with the threshold Hth handled as a cutoff value.

The high wave number component HG to be removed by the high wave number component removal portion 62 contains a noise component which is not contained in the actual patterns Pi and Pj but is made through the operation of the discrete Fourier transformation. Such a noise component causes an error in operation for calculating a travel distance dL at a subsequent stage. In particular, the arithmetic portion 26 normalizes the intensity of components (waveform amplitude) as shown in FIG. 6C. This causes an error due to the noise component to become larger as compared with the case where no normalization is performed on the intensity of components. The high wave number component removal portion 62 removes such a noise component.

In other words, removal of the high wave number component HG by the high wave number component removal portion 62 reduces an error for calculation at a subsequent stage, which enables detection of a travel distance dL with accuracy higher than is conventionally possible. In short, it is possible to reduce an error in detection of the travel distance dL through the discrete Fourier transformation.

Meanwhile, when performing the filter processing, the high wave number component removal portion 62 determines that the threshold Hth used as the cutoff value is a value informed by the CPU 6 of the engine control board 5. Where the CPU 6 instructs the travel distance sensor 2 to detect a cycle h of concave-convex of the paper sheet 8, the travel distance sensor 2 calculates a wave number H8 based on the cycle h of concave-convex determined by performing discrete Fourier transformation on a pattern obtained by image capturing of a pattern of the surface of the paper sheet 8. Then, a margin is added to the calculated wave number H8, and the resultant is determined to be the threshold Hth, for example.

FIG. 8 shows an example of the paper information T1. The paper information T1 is prepared in the form of a table. In the table, a type K8 of the paper sheet 8 comes in three types classified in accordance with smoothness of the paper surface. The table stores, for each paper type, a cycle h of concave-convex, a wave number H8, and a threshold Hth.

The type K8 of the paper sheet 8 includes "non-coated paper (pulp paper or plain paper)" made only from pulp, "coated paper" having a substrate made from pulp with the surface coated with paint or pigment, and "resin paper" such as laminated paper made by coating a surface of pulp with resin or resin film.

Smoothness, namely, a cycle of concave-convex, of non-coated paper is set at a first level. Smoothness of coated paper is set at a second level which is shorter in cycle and higher in wave number than those for the first level. Smoothness of resin paper is set at a third level which is shorter in cycle and higher in wave number than those for the second level.

In the paper information T1, the cycle h of concave-convex indicates a value determined by, for example, averaging actual measured values of the three types of paper sheet 8. The wave number H8 indicates a value determined in advance by calculation based on the determined cycle h of concave-convex and a known frame size (length L). The threshold Hth indicates a value determined in advance by calculation based on the determined wave number H8.

Referring to the values of non-coated paper, for example, the cycle h of concave-convex is "40 μm", the wave number H8 is "50", and the threshold Hth is "60" which is obtained by adding a margin of "10" to the wave number H8, or, by multiplying the wave number H8 by 1.2. The filter processing described above with reference to FIG. 6B uses the value of "60" as the threshold Hth.

Referring back to FIG. 5, before the travel distance calculation portion 66 obtains the travel distance dL, the normalization processing portion 63 normalizes amplitude of each wave number (intensity of wave number component) for the image data Di and Dj on the two patterns Pi and Pj from which the high wave number component removal portion 62 has removed the high wave number component HG. FIG. 6C shows the result of normalization of intensity to a value of "1". The normalization enables omission of calculation for applying a weight depending on a level of the intensity for the case where phase differences for wave number components are added at a subsequent stage as a preprocess for determination of a travel distance dL. Further, the normalization enables prevention of increase in error in calculation of a travel distance dL by accumulation of errors in applying weight. Further, the normalization extends a dynamic range for processing.

The phase difference calculation portion 64 calculates, for each wave number H, a phase difference between the image data Di and the image data Dj, namely, a phase difference between the pattern Pi and the pattern Pj. The calculation by the phase difference calculation portion 64 includes multiplication, for the image data Di and the image data Dj, of pieces of data on a line having the same line number.

The inverse discrete Fourier transformation portion 65 performs, for each line, inverse discrete Fourier transformation on phase difference data pieces for 500 lines sent by the phase difference calculation portion 64. Thereby, an image D65 is generated which has, on each line, a peak depending on a difference between the two patterns Pi and Pj.

The travel distance calculation portion 66 determines a travel distance dL of the paper sheet 8 based on a phase relationship between the two patterns Pi and Pj shown in the image D65. In other words, the travel distance calculation portion 66 calculates, as the travel distance dL, an average of, for example, positions of peaks on all the lines in the image D65.

The data output portion 67 temporarily stores, as the result of detection, the travel distance dL calculated by the travel distance calculation portion 66. Alternatively, the data output portion 67 determines a conveyance speed V of the paper sheet 8 based on the travel distance dL and a predetermined time interval which corresponds to a cycle of image capturing by the imaging sensor 23. The data output portion 67 then stores, as the result of detection, the conveyance speed V instead of the travel distance dL. The data output portion 67 updates the stored result of detection every time a travel distance dL newly calculated by the travel distance calculation portion 66 is inputted. Then, in response to a request to output the speed data DV from the CPU 5, the data output portion 67 outputs to the CPU 5, as the speed data DV, the updated result of detection stored.

Figure 9:
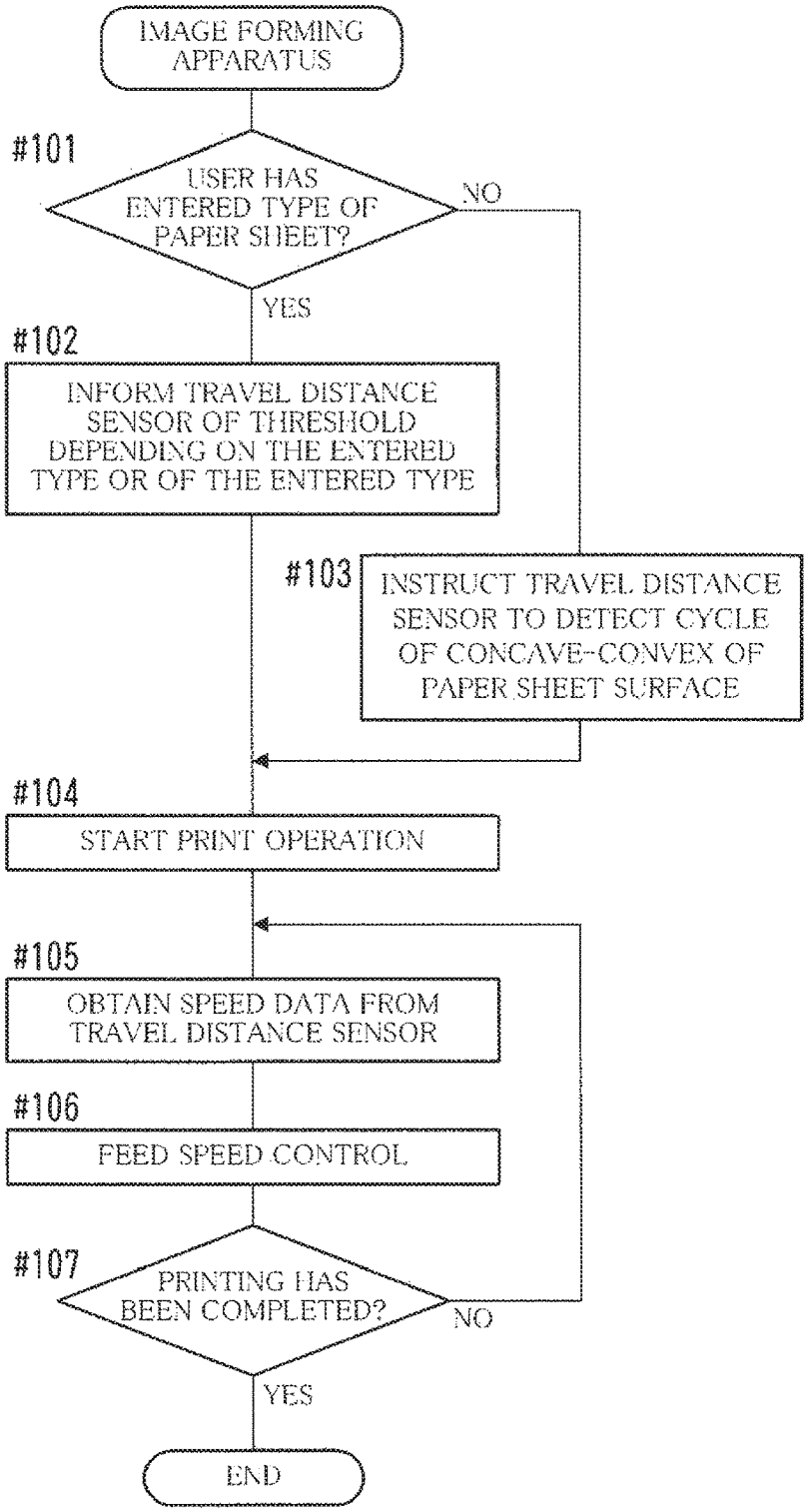
FIG. 9 is a flowchart for depicting an example of the flow of processing in an image forming apparatus.
Figure 10:
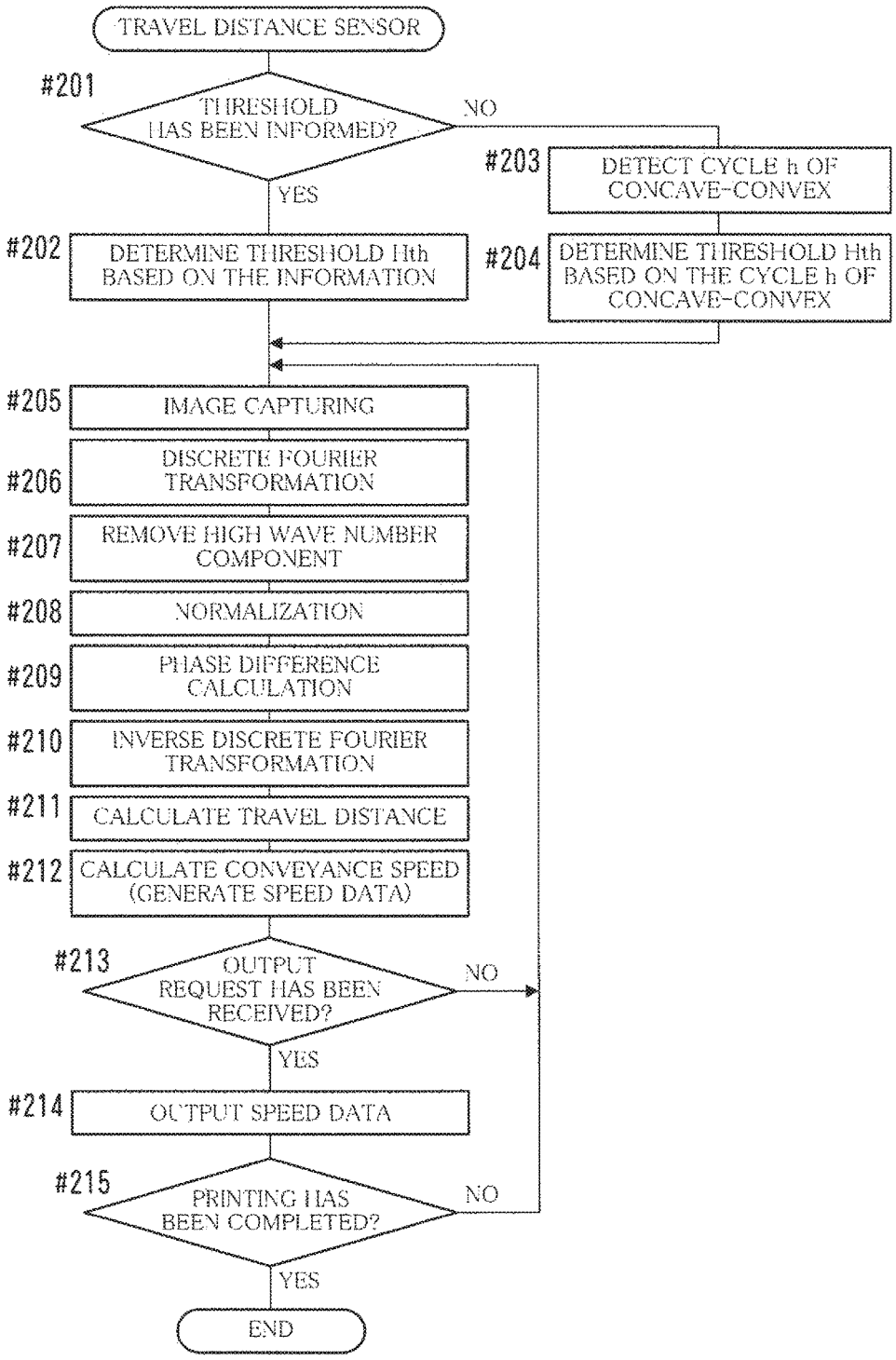
FIG. 10 is a flowchart for depicting an example of the flow of process in a travel distance sensor.

FIG. 9 depicts an example of the flow of processing in the image forming apparatus 1. FIG. 10 depicts an example of the flow of processing in the travel distance sensor 2.

Referring to FIG. 9, when giving a command to execute printing, the image forming apparatus 1 checks whether or not an input to select a type K8 of the paper sheet 8 is received from a user (Step #101). The user can input any one of the three types set in the paper information T1 depending on the paper sheet 8 loaded in the paper feed portion 3. The user may input any one of the three types by using an operating panel of the image forming apparatus 1, or, alternatively, by gaining access from an external device.

When an input to select a type K8 of the paper sheet 8 is received (YES in Step #101), the image forming apparatus 1 reads, out of the non-volatile memory 7, a threshold Hth correlated with the inputted type K8 in the paper information T1 to inform the travel distance sensor 2 of the threshold Hth thus read out (Step #102). Instead of the threshold Hth, the inputted type K8 may be informed to the travel distance sensor 2 in Step #102.

The image forming apparatus 1 starts print operation (Step #104), obtains speed data DV from the travel distance sensor 2 at an appropriate time (Step #105), and performs feed speed control for controlling the rotation of the fixing motor 19 or the like in accordance with the speed data DV obtained (Step #106). When the printing has not yet been completed (NO in Step #107), the image forming apparatus 1 repeats the processing from Steps #105 and #106 to keep the feed speed of the paper sheet 8 at an appropriate speed.

In contrast, when no input to select a type K8 of the paper sheet 8 is received (NO in Step #101), the image forming apparatus 1 instructs the travel distance sensor 2 to detect a cycle h of concave-convex of the surface of the paper sheet 8 (Step #103). After that, the image forming apparatus 1 starts the print operation (Step #104).

Referring to FIG. 10, the travel distance sensor 2 checks whether or not a threshold Hth has been informed by the CPU 6 of the engine control board 5 (Step #201).

When the threshold Hth has been informed (YES in Step #201), the travel distance sensor 2 determines that a threshold Hth to be used for the filter processing in the high wave number component removal portion 62 is the threshold Hth informed.

In contrast, when the travel distance sensor 2 does not receive the threshold Hth, and instead, is instructed by the CPU 6 to detect a cycle h of concave-convex (NO in Step #201), then the travel distance sensor 2 captures an image of a pattern of the surface of the paper sheet 8 while the paper sheet 8 stops, and detects a cycle h of concave-convex of the surface of the paper sheet 8 based on the captured image (Step #203). The travel distance sensor 2 calculates a wave number H8 based on the cycle h of concave-convex detected, and then calculates a threshold Hth by a predetermined, operation such as adding a margin, and determines that a threshold Hth to be used for the filter processing in the high wave number component removal portion 62 is the threshold Hth calculated (Step #204).

After the threshold Hth is determined, the travel distance sensor 2 starts periodic image capturing (Step #205), performs discrete Fourier transformation on the captured pattern Pi (Step #206), removes a high wave number component HG (Step #207), and normalizes the resultant (Step #208).

When obtaining normalized data corresponding to the pattern Pi and normalized data corresponding to the pattern Pj captured subsequent to the pattern Pi, the travel distance sensor 2 performs, based on the data pieces, phase difference calculation (Step #209) and inverse discrete Fourier transformation (Step #210) in order, then calculates a travel distance dL (Step #211). The travel distance sensor 2 then calculates a conveyance speed V based on the travel distance dL to store the conveyance speed V as the result of detection (speed data DV) (Step #212).

When receiving an output request Q1 from the CPU 6 (YES in Step #213), the travel distance sensor 2 outputs the speed data DV stored therein to the CPU 6 (Step #214). When the printing has not yet been completed (NO in Step #215), the travel distance sensor 2 repeats the processing from Steps #205 through #215.

Figure 11:
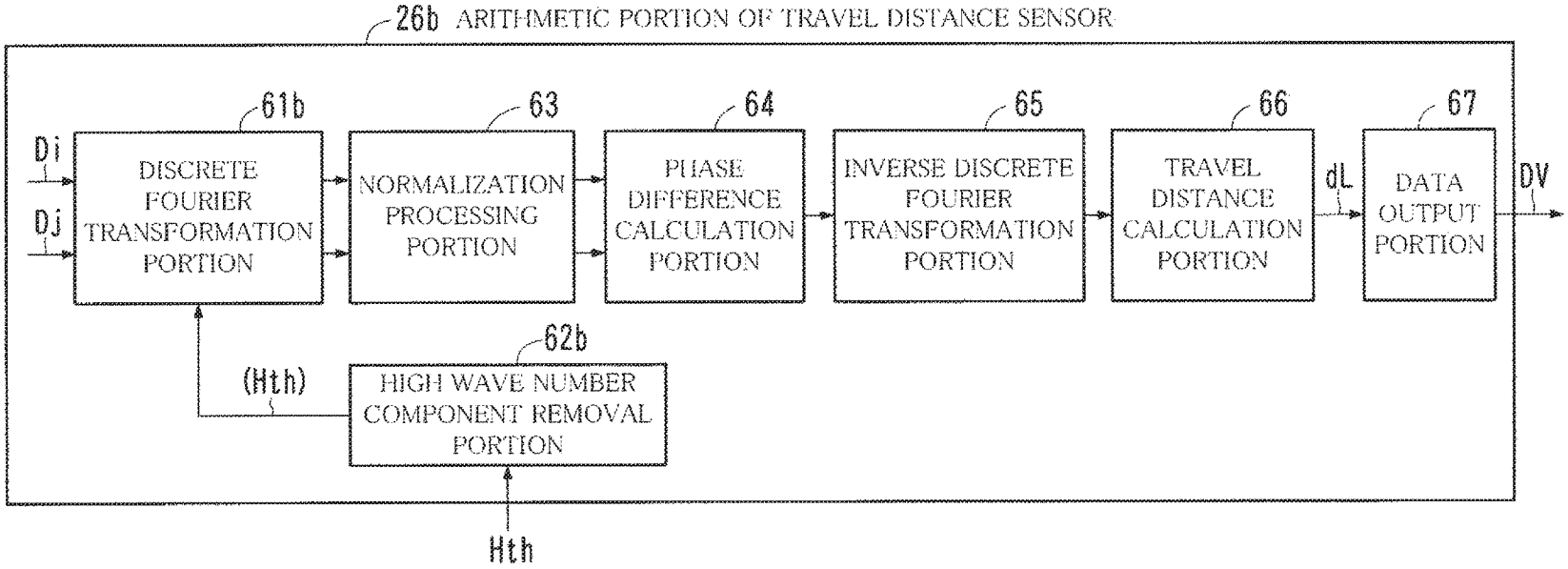
FIG. 11 is a diagram showing a modification of the functional configuration of an arithmetic portion of a travel distance sensor.

FIG. 11 shows a modification of the functional configuration of the arithmetic portion 26 of the travel distance sensor 2. FIG. 11 shows an arithmetic portion 26*b* in which, instead of the discrete Fourier transformation portion 61 of the arithmetic portion 26 shown in FIG. 5, a discrete Fourier transformation portion 61*b* is provided, and, instead of the high wave number component removal portion 62 shown in FIG. 5, a high wave number component removal portion 62*b* is provided. The configuration other than those portions of the arithmetic portion 26*b* is the same as that of the arithmetic portion 26 shown in FIG. 5.

The discrete Fourier transformation portion 61*b* is so configured to generate, at the time of discrete Fourier transformation on inputted data, only data indicating a low wave number component lower than the designated wave number (selected wave number) and the intensity of the low wave number component.

The high wave number component removal portion 62*b* provides the discrete Fourier transformation portion 61*b* with, as an upper limit of the selected wave number, the threshold Hth informed by the CPU 6 or the threshold Hth calculated based on the result of detection of the cycle h of concave-convex. Stated differently, the high wave number component removal portion 62*b* performs control in such a manner that a high wave number component HG exceeding the threshold Hth is not outputted in the discrete Fourier transformation by the discrete Fourier transformation portion 61*b*.

In other words, where the discrete Fourier transformation portion 61*b* performs discrete Fourier transformation to output in order from a basic wave component given a low wave number, the discrete Fourier transformation portion 61*b* does not perform the transformation after the wave number of the threshold Hth is reached, and does not output a component having a wave number higher than the wave number of the threshold Hth.

Thereby, data with the high wave number component HG removed is obtained as with the result of the filter processing by the arithmetic portion 26 of FIG. 5, which enables a travel distance dL to be detected with high accuracy. In short, errors can be reduced for the case where the discrete Fourier transformation is performed to detect a travel distance dL. In addition, time required for discrete Fourier transformation by the discrete Fourier transformation portion 61*b* can be shortened.

In the foregoing embodiments, the paper information T1 is stored in advance in the non-volatile memory 7 of the engine, control board 5, namely, in a storage external to the travel distance sensor 2. As a modification thereto, the paper information T1 may be stored in advance in an internal storage portion of the travel distance sensor 2, for example, in the peripheral circuit 27 or a memory of the operation portions 26 and 26*b*.

In such a case, a type K8 of the paper sheet 8 entered by the user is informed to the travel distance sensor 2, for example, through the CPU 6. Then, for example, the peripheral circuit 27 operates as a sheet determination portion to determine that a type K8 of the paper sheet 8 is the informed type K8. Then, for example, the high wave number component removal portion 62 or 62*b* reads, out of the storage portion, a threshold Hth corresponding to the type K8 determined by the sheet determination portion, thereby to determine that the threshold Hth thus read out is a threshold Hth to be used for removing the high wave number component HG.

The paper information T1 may indicate, instead of a threshold Hth, a cycle h of concave-convex determined in advance depending on a type K8 of the paper sheet 8. In such a case, for example, the high wave number component removal portion 62 or 62*b* reads, out of the storage portion, a cycle h of concave-convex which corresponds to the type K8 determined by the sheet determination portion, obtains the cycle h of concave-convex, and determines a threshold Hth to be used for removing the high wave number component HG based on the obtained cycle h of concave-convex and a size of the image plane of the imaging sensor 23. For example, a wave number H8 is calculated based on the cycle h of concave-convex and the image plane, and a value obtained by adding a margin to the wave number H8 is determined to be a threshold Hth.

In the foregoing embodiments, in order to detect a cycle h of concave-convex of a paper sheet 8, the CPU 6 sends a command for detection, and the travel distance sensor 2 performs detection to calculate a threshold Hth based on the result of detection. As a modification thereto, the travel distance sensor 2 may inform the CPU 6 of a detected cycle h of concave-convex, and the CPU 6 may calculate a threshold Hth depending on the cycle h to inform the travel distance sensor 2 of the threshold Hth. In addition to the travel distance sensor 2, a sensor for detecting a cycle h of concave-convex may be provided in, for example, the paper feed portion 3. Based on the cycle h detected by the sensor, a threshold Hth to be used for removing high wave number component HG may be determined.

With respect to the paper information T1, a threshold Hth is set based on a cycle h of concave-convex of the surface of a paper sheet 8 and a size of the image plane (length L). The threshold Hth may be set by adding parameters related to interference of laser light, for example, the constant of the lens 24 or a distance away from the paper sheet 8.

In the embodiments, the travel distance sensor 2 is provided in the image forming apparatus 1 and is used for detection of a travel distance dL of a paper sheet 8 for printing. The application of the travel distance sensor 2 is not limited thereto. For example, the travel distance sensor 2 may be provided in an image reader and may be used for detection of a travel distance dL of a document sheet.

It is to be understood that the configuration of the travel distance sensor 2, the constituent elements thereof, the content, order, and timing of the processing, classification of the type K8 of a paper sheet 8, the number of classification, the image plane size, the time interval for image capturing, the margin, and the like can be appropriately modified without departing from the spirit of the present invention.

Although the present invention has been described and illustrated in detail, it is clearly understood that the present invention is by way of illustrated and example only and is not to be taken by way of limitation, the scope of the present invention being interpreted by terms of the appended claims.

What is claimed is:

1. A device for detecting a travel distance of a sheet, the device comprising:

a light source configured to irradiate a surface of the sheet;

an imaging sensor configured to capture an image of a pattern of the surface of the sheet by light reflected from the sheet;

a discrete Fourier transformation portion configured to perform discrete Fourier transformation on two patterns obtained by image capturing at a time interval by the imaging sensor;

a high wave number component removal portion configured to use a threshold determined based on a cycle of concave-convex of the surface of the sheet to remove a high wave number component from the two patterns having been subjected to the discrete Fourier transformation; and a travel distance calculation portion configured to determine a travel distance of the sheet based on a phase relationship between the two patterns from which the high wave number component removal portion has removed the high wave number component.

2. The device according to claim 1, wherein the high wave number component removal portion determines the threshold based on the cycle of concave-convex of the surface of the sheet and a size of an image plane of the imaging sensor.

3. The device according to claim 2, wherein the high wave number component removal portion determines the threshold to be a value obtained by adding a margin to a wave number calculated based on the cycle of concave-convex of the surface of the sheet and the size of the image plane of the imaging sensor.

4. The device according to claim 1, wherein types of the sheet is classified into three levels of a first level for paper made only from pulp, a second level for coated paper made from pulp, and a third level for resin paper, and the threshold for each of the three levels is determined in advance as paper information and is stored into a storage portion, the second level having a cycle with a wave number higher than that of the first level, the third level having a cycle with a wave number higher than that of the second level, and the high wave number component removal portion uses the threshold of the paper information.

5. The device according to claim 4, comprising a sheet determination portion configured to determine a type of the sheet, wherein the high wave number component removal portion reads, out of the storage portion, the threshold corresponding to the type of the sheet determined by the sheet determination portion, and determines the threshold read.

6. The device according to claim 1, comprising a sheet determination portion configured to determine a type of the sheet, wherein the cycle of concave-convex is determined in advance depending on the type of the sheet and is stored in a storage portion, and the high wave number component removal portion reads, out of the storage portion, the cycle of concave-convex corresponding to the type of the sheet determined by the sheet determination portion and obtains the cycle of concave-convex, and determines the threshold based on the cycle of concave-convex obtained.

7. The device according to claim 1, comprising a concave-convex cycle detection portion configured to determine the cycle of concave-convex by performing discrete Fourier transformation on a pattern obtained by capturing the image of the pattern of the surface of the sheet.

8. The device according to claim 1, wherein the high wave number component removal portion uses a low-pass filter with the threshold handled as a cutoff value.

9. The device according to claim 1, wherein the high wave number component removal portion performs control in such a manner that a high wave number component exceeding the threshold is not outputted in the discrete Fourier transformation by the discrete Fourier transformation portion.

10. The device according to claim 1, wherein, before the travel distance calculation portion obtains a travel distance, amplitude of each wave number is normalized for the two patterns with the high wave number component removed.

11. The device according to claim 1, wherein the imaging sensor captures images of the two patterns at predetermined time intervals, and a conveyance speed of the sheet is determined based on the travel distance calculated by the travel distance calculation portion and the predetermined time intervals.

12. A method for detecting a travel distance of a sheet, the method comprising:

performing discrete Fourier transformation on two patterns obtained by capturing an image of a surface of the sheet at a time interval;

using a threshold determined based on a cycle of concave-convex of the surface of the sheet to remove a high wave number component from the two patterns having been subjected to the discrete Fourier transformation; and determining a travel distance of the sheet based on a phase relationship between the two patterns from which the high wave number component has been removed.

13. An image forming apparatus, comprising:

a device for detecting a travel distance of a sheet according to claim 1;

a paper feed portion configured to load the sheet therein; and an image forming portion configured to perform control by using a travel distance detected by the device for detecting a travel distance to form an image on the sheet conveyed from the paper feed portion.

* * * * *